United States Patent [19]

Miller

[11] 4,259,748

[45] Apr. 7, 1981

[54] MOISTURE ABSORBENT MASK COVERING THE FACE, NECK AND EARS

[76] Inventor: Anna K. Miller, 218 Capelli Dr., Felton, Calif. 95018

[21] Appl. No.: 143,297

[22] Filed: Apr. 24, 1980

[51] Int. Cl.[3] ..... A41D 13/00

[52] U.S. Cl. ..... 2/9; 2/206; 2/174

[58] Field of Search ..... 2/424, 7, 8, 174, 206, 2/9, 171; 132/49

[56] References Cited

U.S. PATENT DOCUMENTS

| | | | |
|---|---|---|---|
| 766,963 | 8/1904 | Murray | 2/206 |
| 2,716,981 | 9/1955 | More | 2/174 |
| 3,828,366 | 8/1974 | Conrad | 2/9 |

*Primary Examiner*—Doris L. Troutman

*Attorney, Agent, or Firm*—Robert G. Slick

[57] ABSTRACT

A mask is made of an absorbent material which can be moistened and which will protect a person's face, neck and ears while under an electric hair dryer.

1 Claim, 4 Drawing Figures

MOISTURE ABSORBENT MASK COVERING THE FACE, NECK AND EARS

SUMMARY OF THE INVENTION

The purpose of the mask of the present invention is to protect a person's face, neck and ears while under an electric hair dryer.

It takes about thirty minutes to dry average length hair in curlers under an electric hair dryer, exposing the person to a condition similar to a hot desert wind with the result of dried out skin thus promoting wrinkles, reddening of the ears, neck and facial skin, possibly followed by a burning sensation of the mentioned areas.

The circulating dry hot air from the hair dryer also results in drying out and possibly damaging the delicate mucous membranes of the nasal passages.

Another purpose of the mask is to prevent the drying out of the mucous membranes.

Before the mask is applied, it is ordinarily saturated with cool water and wrung out. The dry heat from the hairdryer causes the water in the very absorbent material of the mask to evaporate, keeping the inhaled air moist enough to prevent drying out of the mucous membranes of the nasal passages.

The mask is preferably made of heavy water absorbent cloth such as terry cloth. Across the top of the forehead portion a ¾ inch pocket is formed by folding the material over and sewing it. Through this pocket an elastic band is drawn to hold the mask against the face by placing the elastic band across the back of the head and enable the gathering of the top of the mask to adjust it to the person's hairline; the material of the mask should not cover the hair.

Another such pocket is sewn around the mask and an elastic band is drawn through and strapped over the top of the person's head.

This elastic band again gathers the material to enable a snug fit from under the chin up along the sides of the face. The gentle pressure of the soft, wet material of the mask under the chin has a beneficial action, firming the tissue under the chin.

The openings for the eyes and nose are mere slits of corresponding dimensions which spread apart when the mask is applied, thus enabling the mask to be firm against the areas around the eyes and mouth so very susceptible to wrinkles. During the hairdrying process, the gentle pressure of the wet mask to these wrinkle prone areas has a slight smoothing effect.

Intense heat to a person's head and back of the neck may cause headache, dizziness or weakness in sensitive individuals.

To prevent these symptoms, a scarf like portion extends from the lower part of the mask to be folded from the front of the neck to the back so that the back of the neck is covered by two layers. Thus, the two flaps of the scarf cross each other over the heat sensitive part of the cervical vertebrae region, giving it double protection. The ends of the scarf are folded to the opposite direction over the ears and tucked under the sides of the mask, thus protecting the ears.

The mask of the present invention was developed for use in beauty salons and homes. For sanitary and economical reasons the material used is washable and durable. It can be laundered with the towels used to dry the hair. The mask made of heavy terry cloth will last a relatively long period of time. If the elastic band wears out, it can be easily replaced, thus extending the time period of usefulness of the mask.

DESCRIPTION OF THE PREFERRED EMBODIMENTS

Figure 1:
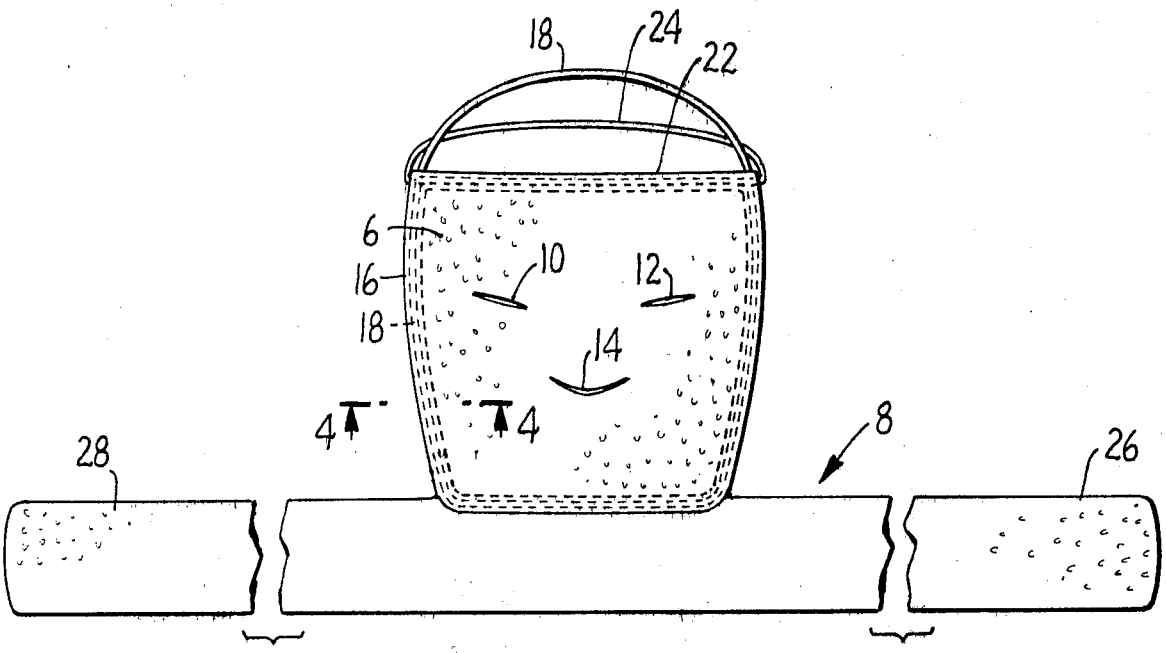
FIG. 1 is a front view of a mask embodying the present invention.
Figure 2:
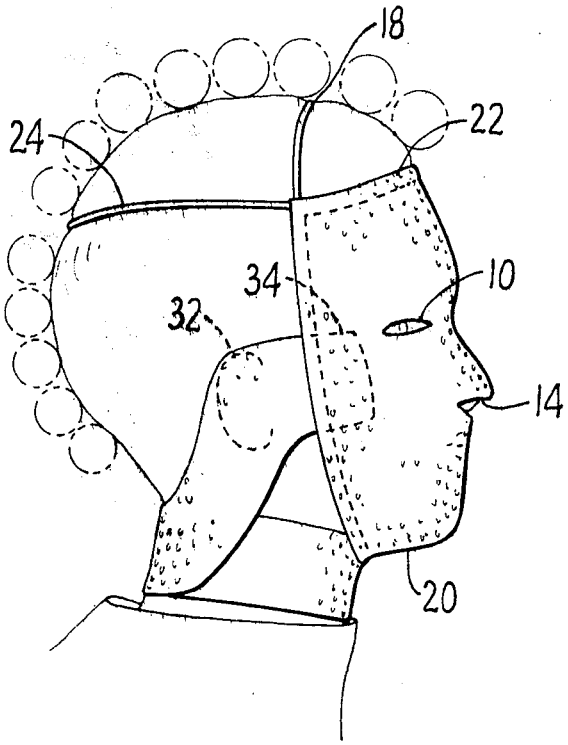
FIG. 2 is a side view showing an individual wearing the mask.
Figure 3:
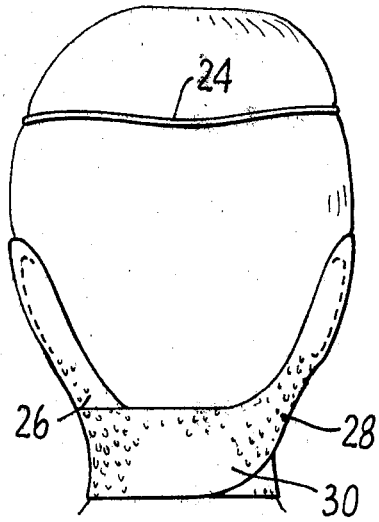
FIG. 3 is a rear view of a person wearing the mask.
Figure 4:
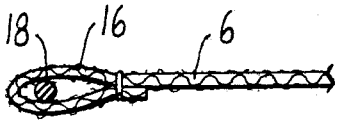
FIG. 4 is an enlarged section on the line 4—4 FIG. 2.

Refering now to the drawings by reference characters, the mask of the present invention consists of two main parts, namely, a face portion, generally designated 6 and a neck portion, generally designated 8. Portions 6 and 8 are made of a soft, moisture absorbent material, such as toweling. The face portion is made large enough to cover the front and sides of the face, as is best seen in FIG. 2. If the material is soft and flexible, it will conform to the shape of the face. The face portion has eye openings 10 and 12 and also a nose opening 14. Normally, there is no opening for the mouth although this may be provided if desired. The sides and the bottom of the mask are provided with a pocket seam as at 16. Through this seam is passed an elastic cord 18 which passes over the top of the head as is shown in FIG. 2. This keeps the face mask in a protective relationship with the lower chin and neck area 20.

A similar pocket seam 22 is provided at the top of the mask and a second elastic cord 24 passes through this seam around the back of the head keeping the mask securely in place.

The neck strap 8 is preferably fabricated from the same piece of material as the face portion 6 although it can be a separate piece of material which is sewn to the face portion. The neck portion 8 is long enough so that the two ends, designated 26 and 28, can be brought around the neck, forming a double layer at the back of the neck as is shown at 30 and the terminal ends are further brought upward and around to cover the ears 32 and tucked under the elastic 18 at the sides of the mask so that the terminal end 34 is held securely in place and, of course, the opposite end is held on the opposite side of the head in the same manner.

In use, the mask would ordinarily be moistened and then placed over the face, neck and ears as shown. The moisture can be replaced from time to time if this is deemed necessary.

It is believed apparent from the foregoing that I have provided a moisture absorbent mask to protect one from a drying influence, such as a hair dryer, wherein the face throat, back of the neck and ears are all protected by the mask.

Although a specific embodiment of the invention has been shown, it will be obvious to those skilled in the art that many variations can be made without departing from the spirit of the invention.

I claim:

1. A mask for protecting a user under a drying influence, said mask comprising in combination:

a. a face portion of an absorbent material;

b. a neck portion of a similar absorbent material;

c. a first elastic cord going around the sides and bottom of the mask adapted to be fastened over the top of a users head;

d. a second elastic cord going around the top of the mask and adapted to be placed back of the users head;

e. the bottom of said mask having a lateral elongated extension with ends whereby the ends can be brought around under the throat, back of the neck and over the ears and tucked under the sides of the mask to provide a double layer of material at the back of the neck as well as protective layers around the face and sides of the neck and over the ears.

* * * * *